US006837692B2

(12) United States Patent
Martinello

(10) Patent No.: US 6,837,692 B2
(45) Date of Patent: Jan. 4, 2005

(54) SELF-PRIMING CENTRIFUGAL PUMP WITH INTERNAL SERIES OF DIFFUSERS AND IMPELLERS AND LAMINAR VALVE

(75) Inventor: Davide Martinello, Arzignano (IT)

(73) Assignee: DAB Pumps S.p.A., Mestrino (IT)

( * ) Notice: Subject to any disclaimer, the term of this patent is extended or adjusted under 35 U.S.C. 154(b) by 0 days.

(21) Appl. No.: 10/221,622

(22) PCT Filed: Jan. 3, 2002

(86) PCT No.: PCT/EP02/00022

§ 371 (c)(1),
(2), (4) Date: Sep. 13, 2002

(87) PCT Pub. No.: WO02/057635

PCT Pub. Date: Jul. 25, 2002

(65) Prior Publication Data

US 2003/0108437 A1 Jun. 12, 2003

(30) Foreign Application Priority Data

Jan. 18, 2001 (IT) ..... PD2001A0013

(51) Int. Cl.[7] ..... F04B 49/00; F04B 23/08; F04B 39/00; F01D 1/12

(52) U.S. Cl. ..... 417/299; 417/199.2; 417/309; 417/435; 415/56.1; 415/56.5

(58) Field of Search ..... 417/199.2, 299, 417/309, 423.1, 435; 137/565.17, 565.37; 415/56.1, 56.3, 56.5, 56.6

(56) References Cited

U.S. PATENT DOCUMENTS 5,513,959 A 5/1996 Mabillot et al.

FOREIGN PATENT DOCUMENTS

| | | |
|---|---|---|
| BE | A-441 667 | 7/1941 |
| EP | A-1 013 936 | 6/2000 |
| FR | A-750 326 | 8/1933 |
| GB | A-1 537 221 | 12/1978 |
| JP | 401310192 A * | 12/1989 |

* cited by examiner

*Primary Examiner*—Cheryl J. Tyler
*Assistant Examiner*—Timothy P. Solak
(74) *Attorney, Agent, or Firm*—Guido Modiano; Albert Josif; Daniel O'Byrne

(57) ABSTRACT

A centrifugal pump with facilitated self-priming, which comprises a casing with a suction inlet and a discharge outlet and with an internal series of diffusers and impellers, which form a cylindrical assembly that forms, together with the casing, an annular interspace which is connected to the inside of the series of diffusers and impellers on the discharge side through corresponding openings and on the inlet side through a hole arranged perimetrically in the intake region; the hole is controlled, on the side of the interspace, by a normally-open flexible metallic laminar valve. A wall of the pump struck by the fluid exiting from the interspace through the controlled hole is shaped so as to have a double symmetrical channel for imparting to the fluid a double vortex before passing through the first impeller.

8 Claims, 6 Drawing Sheets

SELF-PRIMING CENTRIFUGAL PUMP WITH INTERNAL SERIES OF DIFFUSERS AND IMPELLERS AND LAMINAR VALVE

BACKGROUND OF THE INVENTION

The present invention relates to a centrifugal pump with facilitated self-priming.

It is known that centrifugal pumps, in order to ensure optimum operation, must be filled completely with water or, otherwise, with the fluid that they must pump.

The pump is filled beforehand directly by operators or by dedicated equipment and devices, or else the pump must be able to self-prime when it is at least partially filled with fluid.

This self-priming is usually performed with the aid of a valve inserted in the pump itself, which ensures recirculation of the fluid in a sort of hydraulic "short-circuiting" so that the pump reaches the optimum filling state before it actually ejects fluid under pressure.

Once such filling state has been reached, the closure of the self-priming valve allows the pump to resume normal operation with delivery to the outlet provided for this purpose.

SUMMARY OF THE INVENTION

The aim of the present invention is to provide a pump that allows facilitated self-priming, with a considerable increase in safety and efficiency during the starting of said pump.

Within this aim, an object of the present invention is to provide a pump that allows automatic deactivation by interrupting the recirculation of the self-priming step if the optimum level of fluid inside it is reached.

Another object of the present invention is to provide a pump that allows high efficiencies that are fully competitive with respect to similar pumps in the field.

Another object of the present invention is to provide a pump that can be manufactured with the most different dimensions, pressure, and flow-rate capabilities.

Another object of the present invention is to provide a pump that can be manufactured with known technologies and equipment at costs that are competitive with respect to pumps having similar functionality.

This aim and these and other objects which will become better apparent hereinafter are achieved by a centrifugal pump with facilitated self-priming, comprising a casing with a suction inlet and a discharge outlet and with an internal series of diffusers and impellers, which form a cylindrical assembly that defines, together with said casing, an annular interspace which is connected to the inside of said series of diffusers and impellers on the discharge side through corresponding openings and on the inlet side through a hole arranged perimetrically in the intake region, said hole being controlled, on the side of said interspace, by a normally-open flexible metallic laminar valve, said pump being characterized in that a wall struck by said fluid exiting from said interspace through said controlled hole is shaped so as to have a double symmetrical channel which is suitable to impart to said fluid a double vortex before passing through the first impeller.

BRIEF DESCRIPTION OF THE DRAWINGS

Further characteristics and advantages of the present invention will become better apparent from the description of an embodiment thereof, illustrated only by way of non-limitative example in the accompanying drawings, wherein.

DESCRIPTION OF THE PREFERRED EMBODIMENTS

Figure 1:
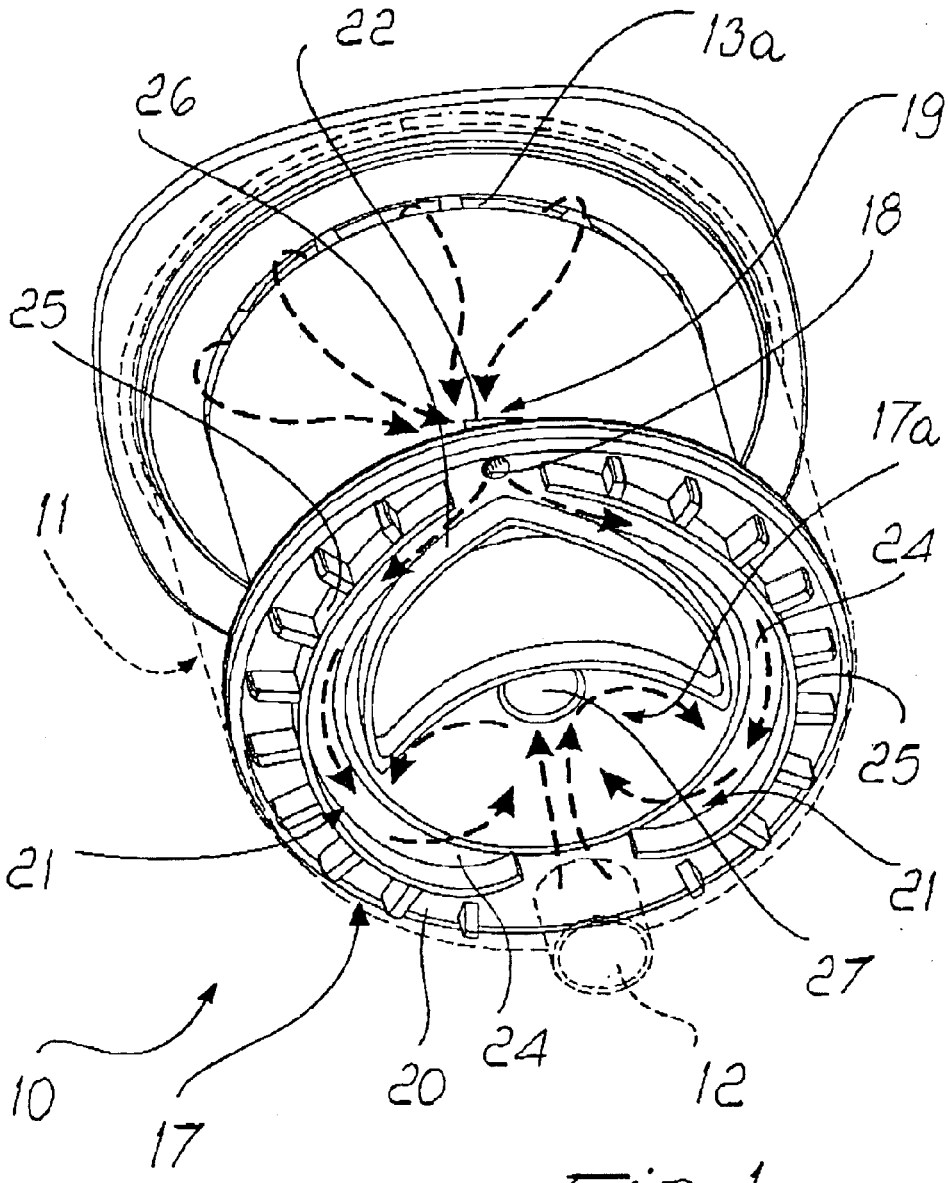
FIG. 1 is a partially sectional perspective view of a pump having the structure according to the invention.
Figure 3:
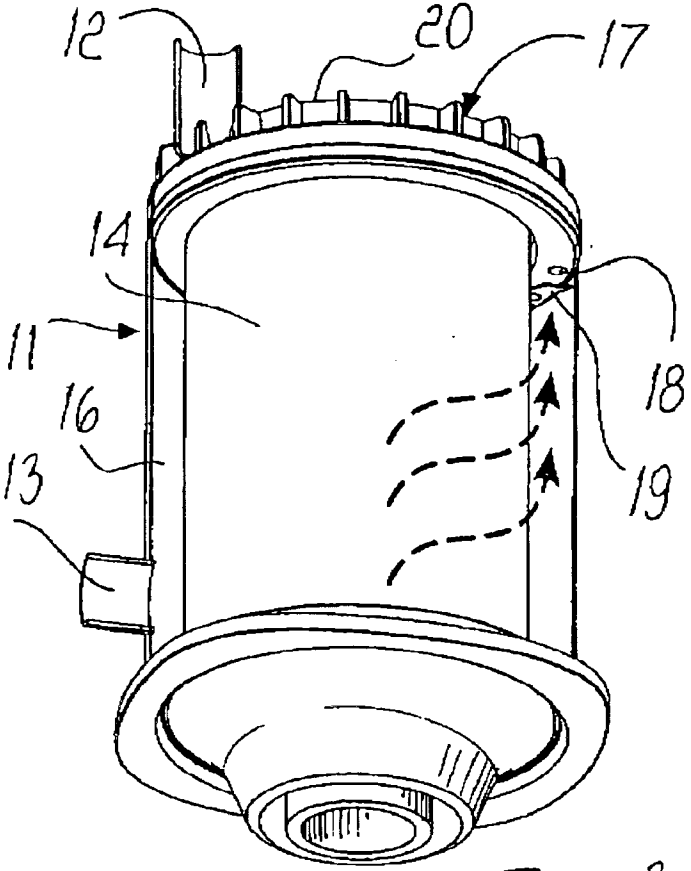
FIGS. 2 and 3 are two partially sectional perspective views of the pump of FIG. 1.
Figure 2:
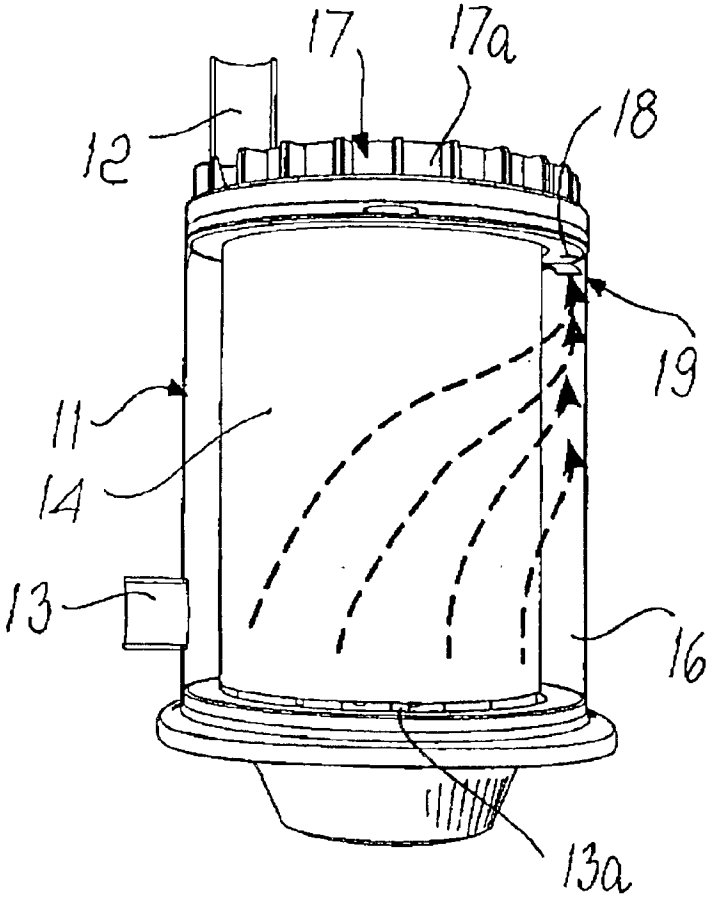
Figure 5:
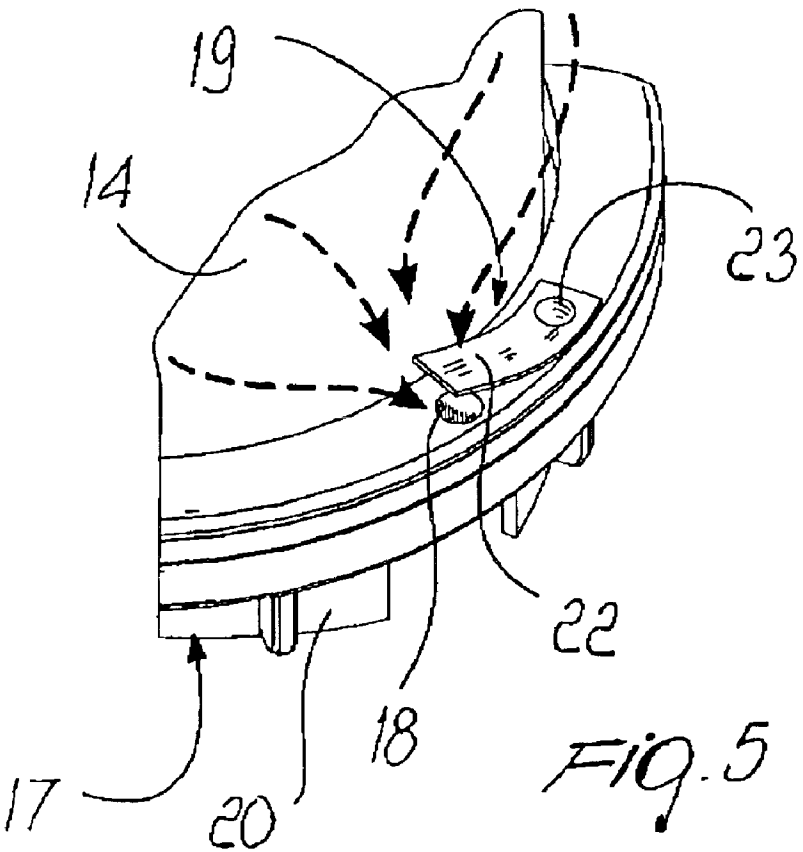
FIGS. 4 and 5 are perspective views, in two distinct steps of operation, of a same detail of the pump of FIG. 1.
Figure 4:
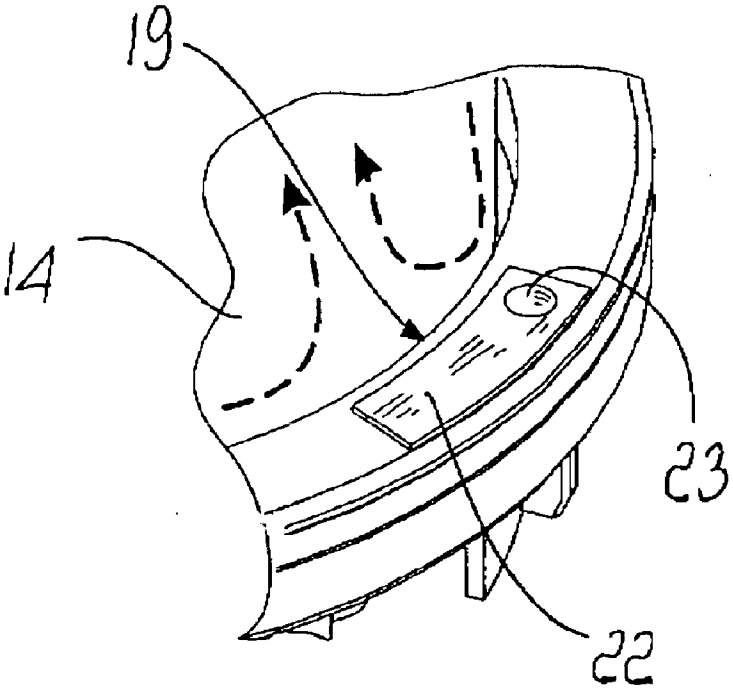
Figure 6:
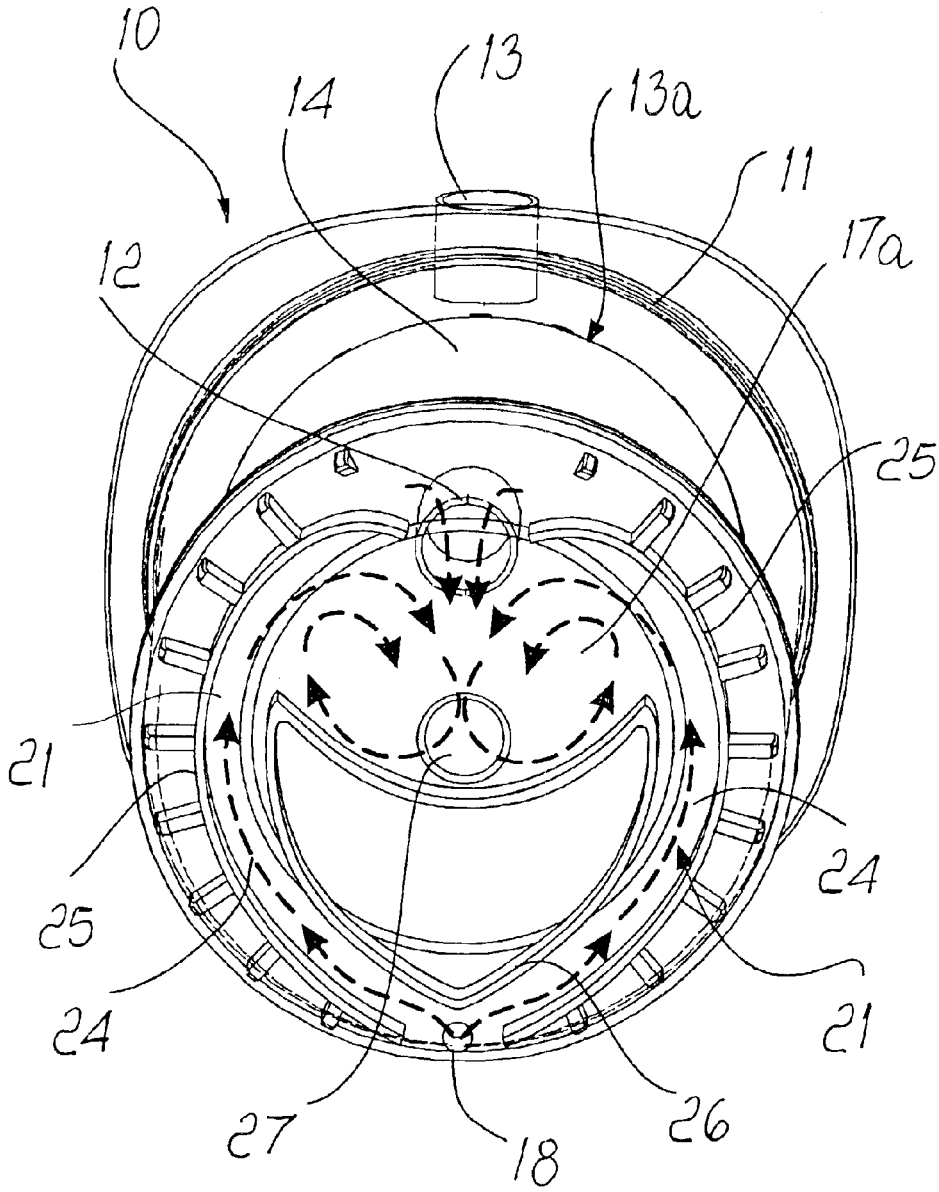
FIG. 6 is another partially sectional perspective view of the pump of FIG. 1.
Figure 7:
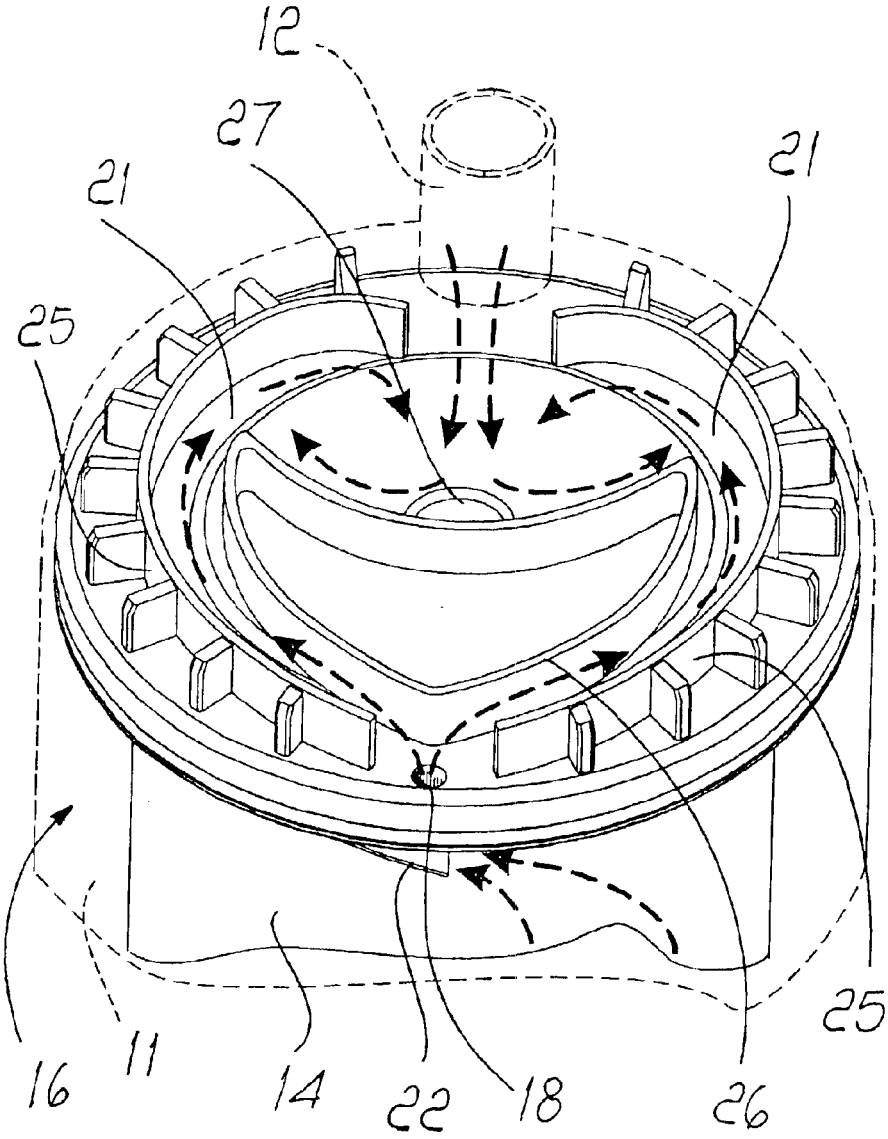
FIG. 7 is a partially sectional perspective view of a portion of the pump of FIG. 1.
Figure 8:
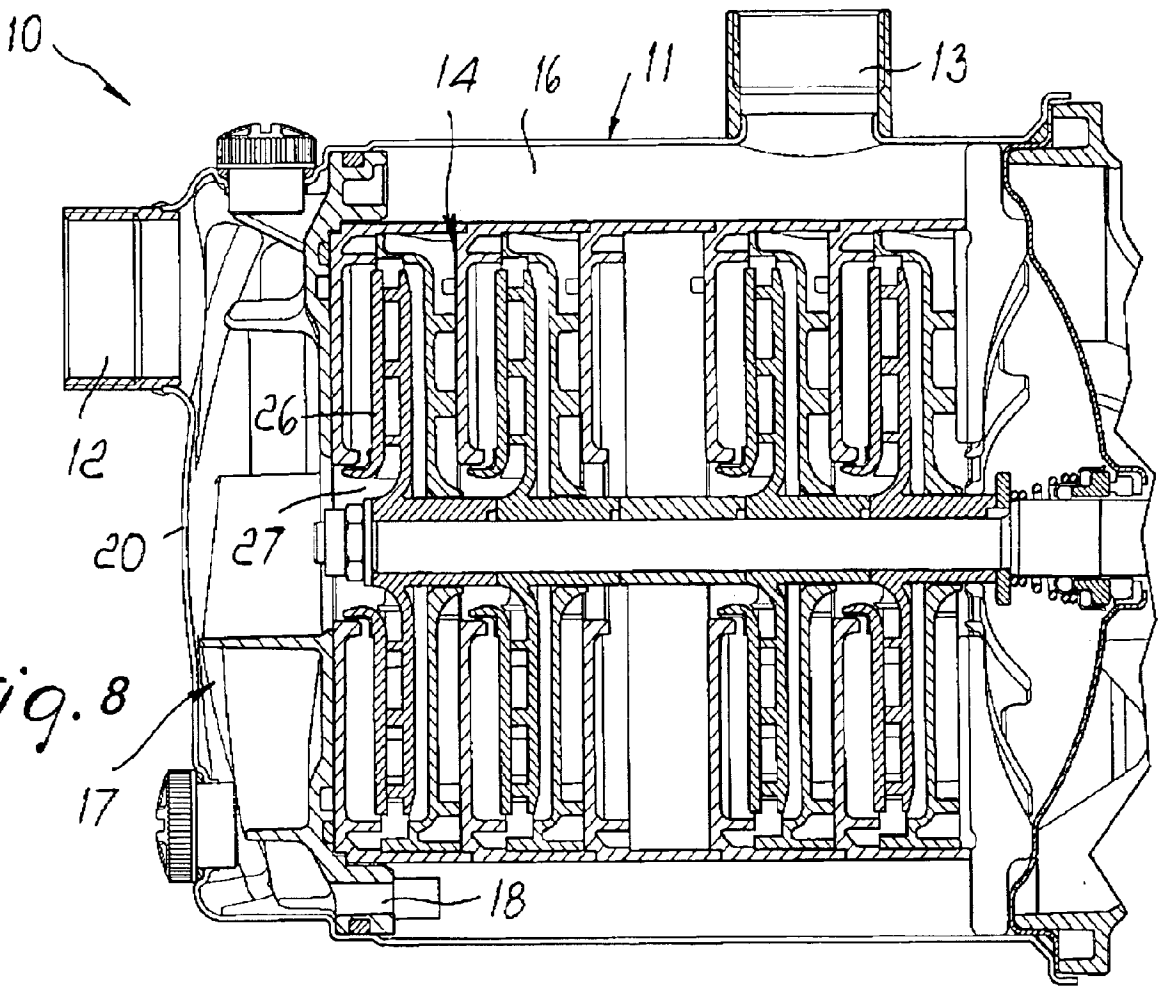
FIG. 8 is a sectional view of the pump, showing diffusers and impellers which are part of the pump according to the invention.

With reference to FIGS. 1 to 7, a centrifugal pump with facilitated self-priming is generally designated by the reference numeral 10.

The pump 10 comprises, in a cylindrical casing 11 with a suction inlet 12 and a discharge outlet 13, a series or set 14 of diffusers and impellers (only the cylindrical outside of which is visible in the figures), which forms, together with the casing 11, an annular interspace 16.

Said annular interspace is connected to the inside of said set 14 through radial discharge openings 13*a* and is connected to a suction chamber 17*a* through a perimetric hole 13 (in the inlet region), which in this case is arranged in a corresponding flange 17 which connects to said interspace 16.

The hole 18 is controlled, on the side of the interspace 16, by a normally-open flexible metallic laminar valve, generally designated by the reference numeral 19.

According to the invention, said flange 17 is shaped, at its face 20 (that is, the wall shuck by the fluid that exits from the hole 18) that faces opposite said set 14, so as to form for the fluid that exits front the interspace 16 through the hole 18 a double channel symmetrical with respect to a diametric axis passing through the hole 18, generally designated by the reference numeral 21, which is suitable to impart to said fluid a double vortex before the suction section.

In particular, the laminar valve 19 is constituted by a metallic lamina 22 which is fixed in a cantilevered manner, in the vicinity of the hole 18, and curves away from said hole 18 but lies above it.

In particular, the lamina 22 is fixed to the diffuser 17 by means of a threaded element 23.

The channel 21 is constituted by two symmetrical channels 24, each of which is shaped like a half-cardioid.

Said channels 24 are formed by an outer peripheral rim 25 shaped like a cardioid and by an inner rim 26 shaped substantially like a triangle with curved sides.

Furthermore, an axial suction hole 27 is formed near the outside perimeter of inner rim 26.

In this case the flange 17 is made of plastics.

In practice, operation of the pump is as follows: during self-priming, the valve 19 is open and thus allows recirculation of the fluid through the hole 18.

This recirculation is allowed until an amount of water sufficient to close said laminar valve 19 has accumulated inside the pump 10.

Once the valve 19 has closed, the fluid can exit normally from the discharge outlet 13 after passing through the suction inlet 27.

In practice it has been found that the present invention has achieved the intended aim and objects.

In particular, it should be noted that the pump according to the invention allows easy and rapid self-priming but ensures automatic termination of said self-priming step.

Moreover, attention is drawn to its constructive simplicity, which however does not reduce the hydraulic and mechanical performance of the pump.

It should also be noted that the generation of vortices determines a substantial improvement of overall hydraulic characteristics also in the typical transition steps, such as indeed self-priming.

The present invention is susceptible of numerous modifications and variations, all of which are within the scope of the appended claims.

Thus, for example, the wall struck by the fluid that exits from the interspace can be formed by the first diffuser of said set of diffusers and impellers.

The technical details can be replaced with other technically equivalent elements.

The materials and the dimensions may be any according to requirements.

What is claimed is:

1. A centrifugal pump for pumping a fluid with facilitated self-priming, comprising a casing with a suction inlet and a discharge outlet and with an internal series of diffusers and impellers, which form a cylindrical assembly that forms, together with said casing, an annular interspace which is connected to the inside of said series of diffusers and impellers on the side comprising the discharge outlet through radial discharge openings and on the side comprising the suction inlet through a hole arranged perimetrically in the inlet side, said hole being controlled, on the side facing said interspace, by a normally-open flexible metallic laminar valve, said pump having a wall lying opposite said series of diffusers and impellers and struck by said fluid exiting from said interspace through said controlled hole, said wall forming a symmetrical double channel, for imparting to said fluid a double vortex before passing through a first impeller of said series.

2. The centrifugal pump according to claim 1, wherein said wall struck by said fluid exiting from said interspace is formed by a flange which divides said interspace from a suction chamber and said wall, and said wall or surface is formed on a face of said flange that faces opposite said series of diffusers and impellers.

3. The centrifugal pump according to claim 2, wherein said flange is substantially disk-shaped.

4. The centrifugal pump according to claim 2, wherein said flange is made of plastics.

5. The centrifugal pump according to claim 1, wherein said wall struck by said fluid exiting from said interspace is formed as a first diffuser of said series of diffusers and impellers.

6. The centrifugal pump according to claim 1, wherein said channel is constituted by two channels, each of which is shaped like a half-cardioid.

7. The centrifugal pump according to claim 6, wherein said two channels are formed by an external peripheral rim which is shaped like a cardioid and by an inner rim which is approximately shaped like a triangle with curved sides.

8. The centrifugal pump according to claim 7, wherein a suction hale is formed outside said inner rim.

* * * * *